United States Patent [19]

Jakobsson

[11] Patent Number: 4,624,080

[45] Date of Patent: Nov. 25, 1986

[54] ARRANGEMENT FOR USE WITH BLASTING EQUIPMENT

[75] Inventor: Klas Jakobsson, Trollhättan, Sweden

[73] Assignee: Bilskade-Service HB, Trollhättan, Sweden

[21] Appl. No.: 653,249

[22] PCT Filed: Jan. 13, 1983

[86] PCT No.: PCT/SE83/00002

§ 371 Date: Sep. 12, 1984

§ 102(e) Date: Sep. 12, 1984

[87] PCT Pub. No.: WO84/02673

PCT Pub. Date: Jul. 19, 1984

[51] Int. Cl.[4] ..... B24C 3/06; B24C 5/02; B24C 7/00

[52] U.S. Cl. ..... 51/410; 51/415; 51/427; 51/425

[58] Field of Search ..... 51/410, 436, 438, 424, 51/425, 427, 415, 273

[56] References Cited

U.S. PATENT DOCUMENTS

| | | | |
|---|---|---|---|
| 2,455,514 | 12/1948 | Mead | 51/425 |
| 3,286,406 | 11/1966 | Ashworth | 51/425 |
| 3,893,262 | 7/1975 | Giese | 51/438 |
| 4,232,487 | 11/1980 | Brown | 51/427 |
| 4,333,277 | 6/1982 | Tasedan | 51/425 |
| 4,505,077 | 3/1985 | Sheesley et al. | 51/415 |

FOREIGN PATENT DOCUMENTS

| | | |
|---|---|---|
| 2928698 | 2/1981 | Fed. Rep. of Germany . |
| 8008862 | 6/1982 | Sweden . |
| 0332849 | 7/1930 | United Kingdom . |

*Primary Examiner*—Frederick R. Schmidt
*Assistant Examiner*—Robert A. Rose

[57] ABSTRACT

A blasting apparatus having a pistol with at least one nozzle for ejecting blasting material. The pistol has a screening device with an outer opening for placement against a workpiece. A suction channel in the screening device is connected to a suction unit. The suction channel opens partly into the screening device and partly into an opening actuated by a trigger. A control unit keeps the supply of compressed air to the nozzle closed when the under-pressure in the suction channel is less than a predetermined level which exists when one or both openings are open. The control unit allows compressed air to reach the nozzle when an underpressure lower than the above-mentioned pressure level exists, which happens when both openings are almost closed. Thus, blasting can only take place when the opening of the screening unit is closed by the workpiece and when at the same time the trigger is actuated.

1 Claim, 3 Drawing Figures

ARRANGEMENT FOR USE WITH BLASTING EQUIPMENT

TECHNICAL FIELD

The invention relates to an arrangement for use with blasting equipment where the orifice through which the blasting sand is sprayed is surrounded by a shield within which there exists an underpressure. The exiting blasting sand is by this means sucked back such that it does not get outside the shield.

BACKGROUND

Blasting with particles such as sand or steel grit is in many respects a suitable method for cleaning or surface treatment. However, flying particles constitute an industrial health hazard, particularly when working with objects which cannot be completely enclosed in an air-tight box. It is, however, known that this disadvantage can be avoided by equipping the orifice, through which the blasting material is ejected, with a shield within which there exists an underpressure. This shield has an opening which is pressed against the object to be blast-treated and in this way the blasting material is prevented from spreading to the immediate surroundings and the treatment can be concentrated to a restricted area without the blasting material spreading diffusely over a larger area. By means of the underpressure the ejected sand is sucked away.

For blasting equipment of this kind it is known that safety features are incorporated which prevent the blasting material from being ejected if the shield opening is unrestricted and not pressed against a workpiece. Thus there is no risk of blasting material being ejected freely through the opening and thereby causing damage.

Such a known safety arrangement is based on registering the underpressure within the shield; if the shield opening is pressed against an object the underpressure is greater than when the opening is unrestricted.

TECHNICAL PROBLEM

It has been shown that a safety arrangement of the type described, and having the correct function, is difficult to realise. The pressure differences within the shield between the restricted and the non-restricted opening can be very small, particularly when one considers irregularly shaped workpieces which allow a certain inleakage of air through the opening. Another disadvantage is that a blasting arrangement of the type described is relatively complicated, having different channels for air supply, blasting material and for leading away of the latter, and in addition arrangements for starting and stopping of the ejector via actuating devices.

Moreover, it has been established that arrangements of said type suffer from the disadvantage that it is difficult to obtain a reasonable spread of blasting material because the free length of the jet must be kept relatively short so that the length of the shield is not impracticably large.

SOLUTION

These disadvantages have been eliminated in the invention by coupling the actuating devices and the safety arrangement in such a way that the automatic actuation via the said underpressure is more definitive and sure. In addition, arrangements for obtaining a better spreading of the jet of blasting material have been effected.

ADVANTAGES

The invention makes for a simpler arrangement than with earlier solutions and moreover for a very positive function. The invention also ensures that the jet of blasting material is given a satisfactorily large spread even for short free lengths, thus enabling a shield with small dimensions to be realised.

BRIEF DESCRIPTION OF DRAWINGS

One form of the invention is shown on the following drawings.

PREFERRED EMBODIMENT

Figure 1:
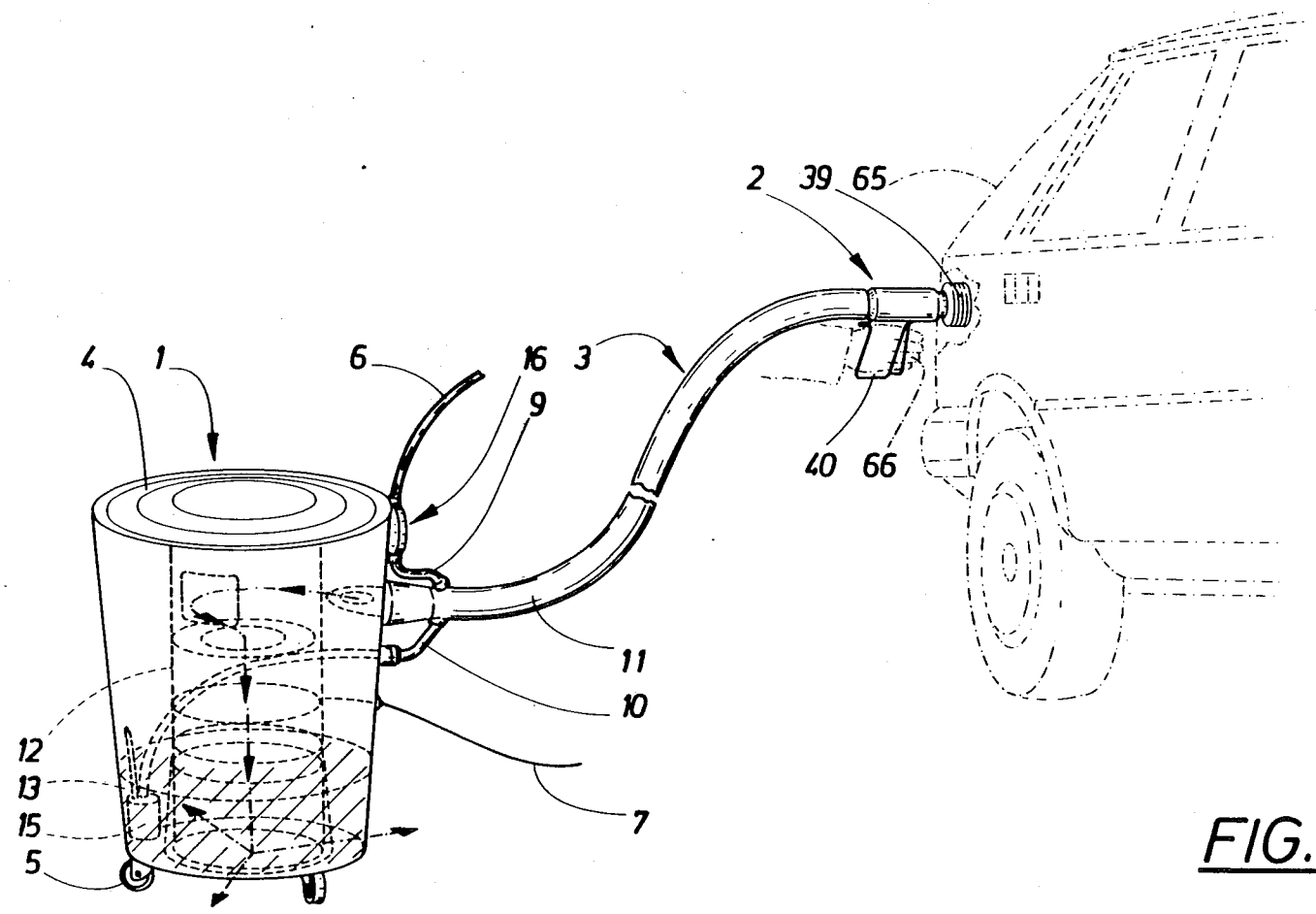
FIG. 1 is a perspective view of a blasting unit in operation.

As shown in FIG. 1, a blasting unit consists of a stationary part 1 and a blasting pistol 2 together with a hose which connects these two main parts. The stationary part 1 consists of a housing 4 which can be equipped with wheels 5. Part 1 is, by means of a hose 6, connected to an air compressor and, by means of a cable 7, to an electrical supply. The stationary part 1 is connected to the pistol 2 by a hose 9 for compressed air and by a hose 10 for the transportation of blasting material to the pistol. A hose 11 returns blasting material from the pistol 2 to the stationary part 1. The hose 11 partly encloses the hoses 9 and 10, and forms a sheath for them.

The cable 7 transmits electric current to an electric fan unit 12 inside the housing 4 by means of which an underpressure is created in the hose 11, and which attempts to transport the blasting material from the pistol 2. In this way blasting material sucked into the housing 4 in the stationary part 1 is left as an accumulation 13 in the bottom of the housing 4. By means of a suction piece 15, which is connected to the hose 10, the blasting material can be sucked from the accumulation 13 and be transmitted to the pistol 2. This is brought about by an underpressure in the hose 10, which is created by the ejector effect in the pistol, to be described later. The supply hose 6 which carries the compressed air to the unit is, in common with the hose 9 which supplies compressed air to the pistol 2, connected to a control unit 16, as shown in detail in FIG. 3.

The control unit 16 consists of a connection nipple 17 for the air supply hose 6 and a connection nipple 18 to connect the air supply hose 9 to the pistol. In addition there is a connection nipple 19 to connect the control unit 16 to the hose 11 for the return of blasting material from the pistol. The nipple 19 can thereby be connected directly to the hose 11 or its connection piece in the housing 4 which ought to give the most accurate and quickest pressure transmission. However, the pressure in the upper part of the housing 4, for the particular construction shown in FIG. 1, where the return hose 11 meets the upper part of the housing, is representative of the pressure in the suction hose 11 even if delays in pressure changes occur. The nipple 19 can therefore, as an alternative, be connected to the space in the upper part of housing 4.

In the control unit 16 the hose 6 is connected to a valve chamber 22 via the nipple 17 and a channel 21. A seat 23 within the valve chamber 22 is connected to an output channel 24. The output channel 24 is connected in its turn to a channel 25 which via the nipple 18 is connected with hose 9.

Inside the valve chamber 22 there is a valve body 26 which extends through a seal 27. The valve body 26 is supported in a membrane 28, which divides two volumes 29 and 30 from one another. The volume 29 is open to the environment via a channel (not shown) and the volume 30 is via the nipple 19 either directly or indirectly connected with the suction hose 11.

Figure 3:
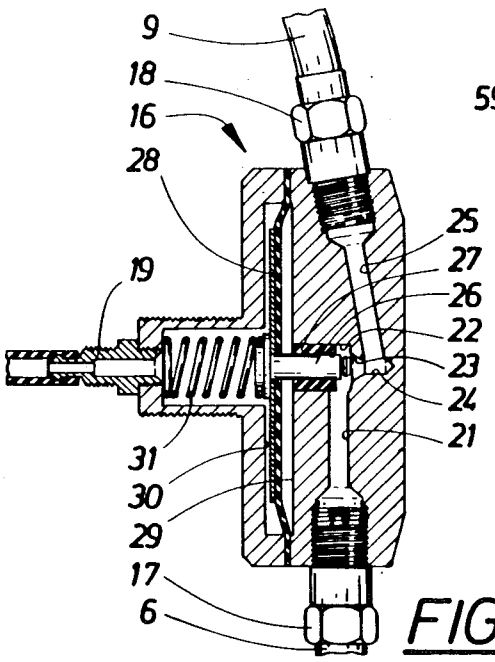
FIG. 3 shows a section through the control gear used with the said safety arrangement.

The membrane 28 is influenced by a spiral spring 31, which pushes the valve body 26 against the valve seat 23. The spring tension is so adjusted that if a given underpressure exists in chamber 30 the outer air pressure causes the membrane to move towards the left in FIG. 3, such that the valve body 26 opens as indicated in FIG. 3. Thus the connection between channels 21 and 25 is opened and thereby also between hoses 6 and 9. If the said underpressure does not exist in chamber 30 then the spiral spring 31 forces the valve body 26 to lie against seat 23 and thus the connection between channels 21 and 25 is broken. How the underpressure, which exceeds the force exerted by the spring and opens the connection between channels 21 and 25, is established will become clear from the following functional description.

Figure 2:
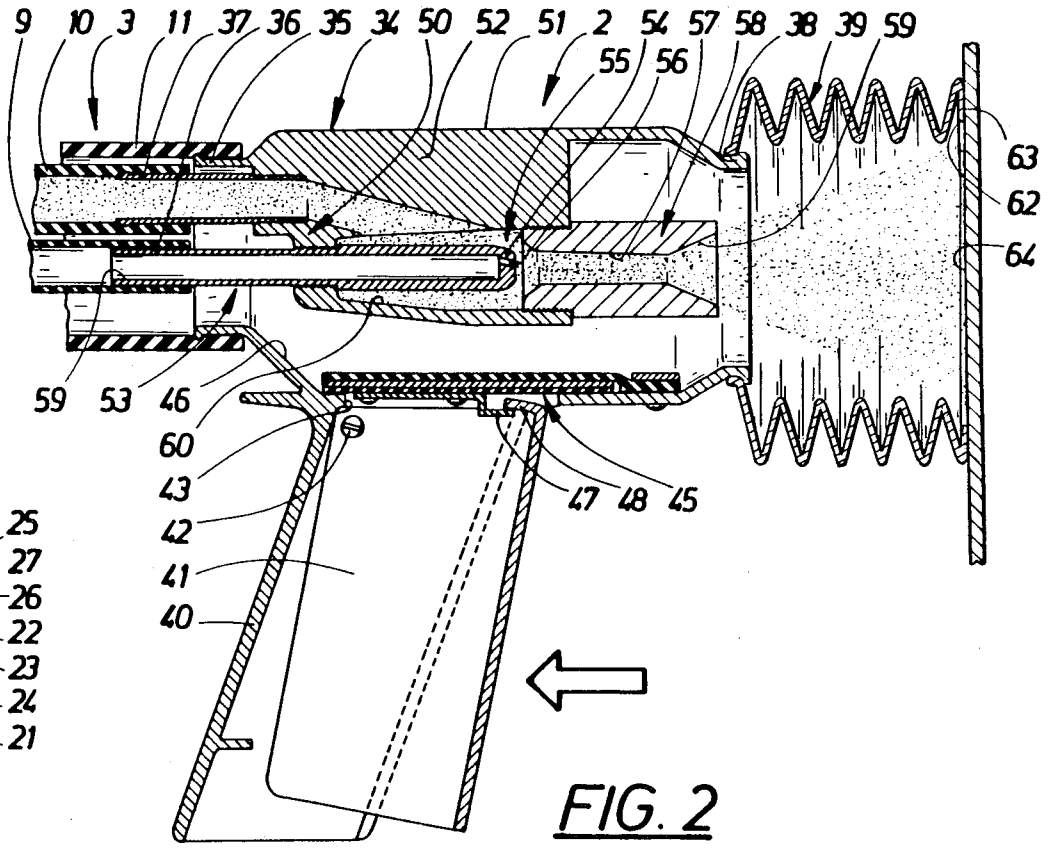
FIG. 2 shows a section through the blasting pistol used with the unit.

Hoses 9, 10 and 11 extend, as previously mentioned, between the stationary part 1 of the equipment and the pistol 2 and form thereby the connection 3. As shown in FIG. 2 and to a certain extent also in FIG. 1, the hoses 9 and 10 are inside hose 11 which thereby forms a sheath around the former hoses. The cross-sectional area of hose 11 thus corresponds with the total inner cross-sectional area of connection 3 less the sum of the outer cross-sectional areas of hoses 9 and 10. By means of this design solution a single and relatively supple connection is obtained between the stationary part and the pistol whilst at the same time maintaining a relatively large cross-sectional area for hose 11, which is desirable.

According to FIG. 2, the pistol consists of a main part 34 whose rear portion takes the form of a stub pipe 35 for the hose 11, said stub pipe in its turn containing stub pipes 36 and 37 for hoses 9 and 10. At the opposite (front) end the main part 34 takes the form of a stub pipe 38 for a bellows 39 made of rubber or similar material, which forms said sheath and which contains the jet of blasting material.

Attached to one side of the main part 34 is a handle 40 whose lower and front sides are open. In the front opening is a trigger 41 which can rotate about an axle 42. The trigger is also open at the bottom and opposite this lower opening is an opening 43 in the main part 34. The opening 43 can be closed by means of a flap 45 as shown in FIG. 2. If the flap is open an inner volume 46 in the main part 34 is open to the surroundings through the open channel formed by the handle 40 and the trigger 41.

The flap 45 is constructed partly of a stiff material such as steel and partly of a rubber-like elastic material which facilitates a good seal around the opening 43. A hook 47 is formed in the hard material, and this hook is arranged to correspond with a hook 48 on the trigger 41, which hook is situated at a distance from the axle 42. The flap 45 is arranged such that its spring tension causes it to try to swing inwards and thus keep the opening 43 open. If, however, the trigger 41 is pressed in, the hook 48 pulls the hook 47 down, and thus the whole of flap 45, such that contact with the edge of the main part 34 around the opening 43 is maintained, thus ensuring a seal. If the trigger is released it swings outwards from the handle 40 under the action of the spring force in the flap 45, which is thereby opened.

Within the chamber 46 in the main part 34 is a central portion 50 which is fixed to the casing which is formed by the outer section 51 of the main part 34 and one or more bridging pieces 52. These bridging pieces do, however, allow free flow between the stub pipes 35 and 38. The stub pipe 36 for the hose 9 is centrally positioned within the central part 50 and consists of a pipe section 53 whose forward end forms an air manifold 55. The manifold 55 is formed by an axial blind hole 59 which extends from the stub pipe 36. The wall 54 formed by the end of the blind hole 59 and the end plane of the manifold is pierced by an inclined and eccentric hole 56.

This hole 56 opens into the barrel 57 of an orifice 58, which terminates in the stub pipe 38 through a conical section 59. The end of pipe 53 and the air manifold 55 are situated in a chamber 60 within the orifice 58. A channel from the stub pipe 37 opens into this chamber, such that the chamber is connected with hose 10.

The bellows 39 has an external opening 62 and its edge 63 around this opening is designed to be pressed against the periphery of the area to be blasted. This area is represented by 64 in FIG. 2. As the figure shows, the space from the opening 62, through the bellows 39 and through the inner chamber 46 forms a channel which is connected to the hose 11. This channel is open via opening 62 when the edge 63 of the bellows is not pressed against a surface and has also an entrance through the handle 40 and the trigger 41, if the latter is not depressed such that the flap 45 is kept open. If, however, the trigger is depressed the latter opening is closed by flap 45 and if at the same time the bellows 39 is pressed against a surface then opening 62 is closed, but not tightly.

When blasting a surface, such as the surface 64, which according to FIG. 1 can be a small area of the bodywork of a motor car 65, the hose 6 is pressurised and the fan unit 12 is started by switching on the electric current, supplied via the cable 7. The fan unit generates an underpressure in the housing 4 and in the hose 11 and also in the chamber 46 in the pistol 2. If one assumes that the bellows 39 by means of its opening 62 is not placed against a surface and that the trigger 41 is not depressed then, by means of said underpressure, air will be sucked in through the opening 62 in the bellows 39 and through the channel formed by the handle 40 and the trigger 41 and thereafter through the opening 43. With the trigger not depressed the flap 45 is open, as previously stated.

Since under these conditions the air can enter relatively freely, an insignificant underpressure is generated in the hose 11 and the housing 4. The pressure in chamber 30 in the control unit 16 is connected via nipple 19 to the volume formed by hose 11 and housing 4, and thus the pressure in the chamber 30 approaches atmospheric pressure which also exists in the chamber 29 on the other side of the membrane 28. The valve body 26 is affected only by the spring 31, and thus is held in its closed position resting on the seat 23. Compressed air from the hose 6 can therefore not be transmitted to the hose 9 and the injection orifice in the pistol 2 is therefore not pressurised.

If the trigger 41 is depressed the flap 45 is closed. In this way a smaller entrance area for outside air is formed, but the air can still stream in through the relatively large bellows opening 62. The spring 31 in the control unit 16 is so adjusted that it can still overcome the now somewhat larger pressure difference between the chambers 29 and 30. The valve body 26 thus still keeps the connection between hoses 6 and 9 closed. The blasting material can still not be ejected. This is also the intention; the material cannot be ejected so long as the bellows opening is unrestricted, since ejected material could be dangerous. Even if one depresses the trigger without placing the bellows against a surface, no ejection of blasting material can take place.

If, without depressing the trigger 41, one places the edge 63 of the bellows 39 against a surface, such as the area 64, such that the opening 62 is covered, the pressure conditions will be roughly the same as just described. Although the entrance area is reduced sufficient air can be drawn in through the opening 43 such that the resistance of the spring 31 cannot be overcome. Thus ejection of blasting material does not occur even if the bellows is, perhaps accidentally, placed against an object, so long as the trigger is not depressed at the same time.

When the edge 63 of the bellows 39 has been placed on a surface such that the greater part of the opening 62 is covered and the trigger 41 is depressed such that the flap 45 closes, then at least the greater part of the entrance openings for air to the hose 11 are closed. This gives rise to an increased underpressure in hose 11 and housing 4 and thus also in the chamber 30 in the control unit 16. The spring 31 is so adjusted that this pressure difference between chambers 29 and 30 can overcome the spring force such that the membrane and the valve body 26 move in a direction away from the valve seat 23. In this way the connection between hoses 6 and 9 is opened as shown in FIG. 3.

Compressed air from hose 9 will now stream into the tube 53 and out through the inclined hole 56. Thus a powerful air flow is established through the barrel 57. By means of the ejector effect an underpressure is generated in chamber 60, which in its turn is connected to hose 10.

The hose 10 is connected via the inlet orifice 15 to the storage space 13 in the blasting material housing 4 and by means of said underpressure the blasting material is sucked through the hose 10 to the orifice pipe 53 and then follows the ejected air stream through the barrel 57 to be dispersed by the conical section 59 and strikes the surface 64 in front of the opening 62 in the form of a broad jet.

Those blasting material particles which strike the surface 64 lose their speed and are trapped in the air stream, driven by the underpressure in hose 11, which sweeps through the bellows 39 and out through the hose 11. In spite of the fact that the edge 63 of the bellows 39 is in contact with the surface 64, a certain amount of air can be sucked in, due to said underpressure, such that said inwardly travelling air stream is established. Experience shows that this air stream is sufficient to cause the blasting material to be sucked in, such that it is not dispersed outside the confines of the bellows 39. This enables blasting to take place without making a mess, or otherwise affecting the environment outside the blasted surface.

The blasting material is transported back to the container 1 via hose 11 and is separated in the fan unit 12 such that the material lands in the storage area 13. The cleaned air stream is ejected to the environment via an output filter in the base of the container, as indicated by arrows in FIG. 1. Blasting material is sucked up again from the storage area 13 via orifice 15 so long as compressed air flows out through the orifice tube 53. The blasting material is thus continuously recycled through the blasting unit and a relatively small amount is needed to keep the process going.

Lifting the bellows from the surface results in a larger in-flow of air as mentioned before, such that the underpressure is not sufficient to hold the valve body 26 open and the connection between hoses 6 and 9 is broken, and the ejection of blasting material stops immediately.

If it is desired to stop the blasting by operation of the trigger, it is only necessary to release it whereupon the flap 45 lifts and air rushes in through the opening 43. In this way the connection between hoses 6 and 9 is broken as previously described and the ejection of blasting material stops.

By means of the principle described no special compressed air valve is required in the pistol; the control unit 16 is the only device necessary for control of the equipment when connected to the compressed air and electrical supplies.

As the exit hole 56 in the manifold 55 is inclined to the axis of symmetry of the tube 53 a turbulent air flow is created in the barrel 57. This turbulence ensures that the air jet assumes a conical form as it flows out through the conical exit section 59 of the orifice 58. The entrained blasting material follows the air stream and in the short distance corresponding with the depth of the bellows 39 assumes a much greater and at the same time a more uniform dispersion than would have been the case with a linear air flow through the barrel 57. In this way the whole area within the bellows opening 62 is covered even if this is large in comparison with the length of the bellows, and a uniform blast effect on the surface is obtained.

I claim:

1. A blasting apparatus comprising: a blasting pistol, said pistol having a first hose nipple, a second hose nipple, and a third hose nipple, a nozzle connected to said first hose nipple, a housing surrounding said nozzle and connected to said second hose nipple, said housing having an outlet for blasting material; a screening device enclosing said housing and having a first opening for placement against a work piece, a suction channel extending from inside said screening device and ending in said third hose nipple, said screening device having a second opening, a valve in said second opening, and a trigger for actuating said valve; a stationary unit comprising: first nipple means, second nipple means, and third nipple means; a control valve having an inlet for compressed air from a supply source, an outlet for compressed air terminating in said first nipple means, a valve body between said inlet and outlet for interrupting the connection between the inlet and outlet in a first position and in a second position holding the connection open, said valve body having an actuating portion having a first side facing a chamber and a second side under the pressure of the surrounding air, a spring biasing said valve body into said first position when the pressure in the chamber is substantially the same as the pressure of the surrounding air, while allowing the valve body to be in said second position when the pressure in the chamber is at a predetermined value lower than the pressure of the surrounding air, said second nipple means being connected to the chamber, a container with a space for blasting material, an electric suction unit with an inlet connected to said second nipple means and an outlet connected to said space, in said space a suction head with an inlet in contact with the blasting material and connected to said third nipple means; hose means between said pistol and said stationary unit and including three conduits: a first conduit for compressed air and connecting said first hose nipple of said pistol with said first nipple means of the stationary unit; a second conduit forming a suction channel and connecting said third hose nipple with said second nipple means; and a third conduit for blasting material and connecting said second hose nipple with said third nipple means; whereby, when both the first opening of the screening device is closed by being pressed against the workpiece and the second opening is closed by closing said valve with said trigger, the predetermined lower pressure is reached in the chamber, the valve body will open the supply of air to the nozzle so that the nozzle operates as an ejector pump, thereby sucking blasting material through said suction head from said space to form a jet against a workpiece situated in the first opening of the screening device.

* * * * *